United States Patent [19]

van der Heijden et al.

[11] Patent Number: 4,920,297

[45] Date of Patent: Apr. 24, 1990

[54] ELECTRIC LAMP

[75] Inventors: Johannes M. A. van der Heijden; Pierre L. L. M. Derks, both of Eindhoven; Cornelis Penning, Oss, all of Netherlands

[73] Assignee: U.S. Philips Corporation, New York, N.Y.

[21] Appl. No.: 353,201

[22] Filed: Dec. 21, 1988

Related U.S. Application Data

[63] Continuation of Ser. No. 43,902, Apr. 29, 1987, abandoned.

[30] Foreign Application Priority Data

Apr. 29, 1986 [NL] Netherlands ..... 8601092
Sep. 22, 1986 [NL] Netherlands ..... 8602378

[51] Int. Cl.[5] ..... H01J 7/00

[52] U.S. Cl. ..... 313/315; 313/318; 315/57; 315/58

[58] Field of Search ..... 315/57, 58, 56, 50; 313/315, 318, 634; 439/360, 616, 615

[56] References Cited

U.S. PATENT DOCUMENTS

| | | | |
|---|---|---|---|
| 2,336,529 | 12/1943 | Cartun | 439/615 |
| 3,775,634 | 11/1973 | Hasell et al. | 439/615 |
| 4,295,076 | 10/1981 | Eckhardt et al. | 439/615 |
| 4,383,200 | 5/1983 | Van Zon et al. | 315/57 |
| 4,496,874 | 1/1985 | Sanders et al. | 439/616 |

*Primary Examiner*—Leo H. Boudreau
*Assistant Examiner*—Michael Razavi
*Attorney, Agent, or Firm*—Brian J. Wieghaus

[57] ABSTRACT

Electric lamp having a lamp envelope and a synthetic material lamp bowl which is secured to the lamp envelope and is provided with a lamp cap (7). The lamp envelope, on its side facing the lamp bowl, is provided with a plurality of projecting plate-shaped members extending substantially parallel to the lamp axis (A-B). The inner wall of the lamp bowl has ribs which also extend substantially parallel to the lamp axis. The plate shaped members engage the ribs to secure the lamp envelope to the lamp bowl.

14 Claims, 1 Drawing Sheet

ELECTRIC LAMP

This is a continuation of application Ser. No. 043,902 now abandoned, filed Apr. 29, 1987.

BACKGROUND OF THE INVENTION

The invention relates to an electric lamp provided with a lamp envelope and a lamp bowl of a synthetic material which is connected at one end to the lamp envelope and has a lamp cap at its other end. A lamp of this type is known from U.S. Pat. 4,383,200.

The known lamp is a compact low-pressure mercury vapor discharge lamp with a cap at one end and having a glass lamp envelope accommodating a hook-shaped fluorescent discharge tube which is sealed in a gas-tight manner. Such a lamp is used as an alternative to an incandescent lamp for general illumination purposes. Furthermore, the lamp includes an electric stabilization ballast and a starter which are partly accommodated in the space bounded by a slightly tapered lamp bowl of synthetic material.

The lamp bowl of the said lamp is screwed onto the lower side of the lamp envelope, for which purpose the lamp envelope has a screwthread or special projections for fixation.

In the British published Patent Application 2,154,057 corresponding to U.S. Pat. No. 4,645,967. an electrodeless low-pressure mercury vapor discharge lamp is disclosed in which the glass bulb-shaped envelope of the lamp vessel is secured to a lamp bowl of synthetic material by means of a clamping joint.

It is a time-consuming and rather complicated matter to realize the joint between the lamp bowl and the lamp envelope during the manufacture of the lamps, notably in a bulk-manufacturing process of these lamps.

SUMMARY OF THE INVENTION

It is an object of the invention to provide a lamp in which a reliable and rigid connection between the lamp envelope and the lamp bowl is established in a simple manner during manufacture of the lamp.

According to the invention, a lamp of the type described in the opening paragraph is therefore characterized in that, for connection to the lamp bowl, or shell the lamp envelope is provided on its side facing the lamp bowl with a plurality of projections or tongues spaced apart from one another and extending substantially parallel to the lamp axis, which tongues are undetachably accommodated between guides or ribs on the inner wall of the lamp bowl, which ribs also extend substantially parallel to the lamp axis.

The lamp according to the invention can be easily manufactured in a bulk-manufacturing process. The said projections are fixed, for example, by means of an adhesive (such as glue or cement) to the lower side of the bulb-shaped lamp envelope. When the lamp envelope is fixed to the lamp bowl, the said projections are pressed between the ribs and anchored, for example, by means of portions of the members (projections) engaging with the ribs and the members (projections) in the axial direction.

The said projections are preferably formed as plate-shaped members with pairs of resilient metal barbs which are anchored in synthetic material ribs. A reliable connection between the lamp bowl and the lamp envelope is then obtained. In addition, an ample tolerance for differences in shape of the different envelopes and lamp bowls is achieved during manufacture.

In a preferred embodiment the projections form part of an annular strip which is secured to an edge position of the lamp envelope facing the lamp bowl. This strip consists of, for example, metal and is sealingly joined to the outer wall of the envelope by means of an adhesive. The strip and the members are preferably punched as a single component.

The lamp according to the invention is formed, for example, as a compact fluorescent low-pressure mercury vapor discharge lamp or as an electrodeless low-pressure discharge lamp. Such lamps are used as alternatives to incandescent lamps for general illumination purposes. However, the invention may also be used for certain types of incandescent lamps or high-pressure discharge lamps.

BRIEF DESCRIPTION OF THE DRAWINGS

The invention will be described in greater detail with reference to the accompanying drawing. In this drawing

Figure 1:
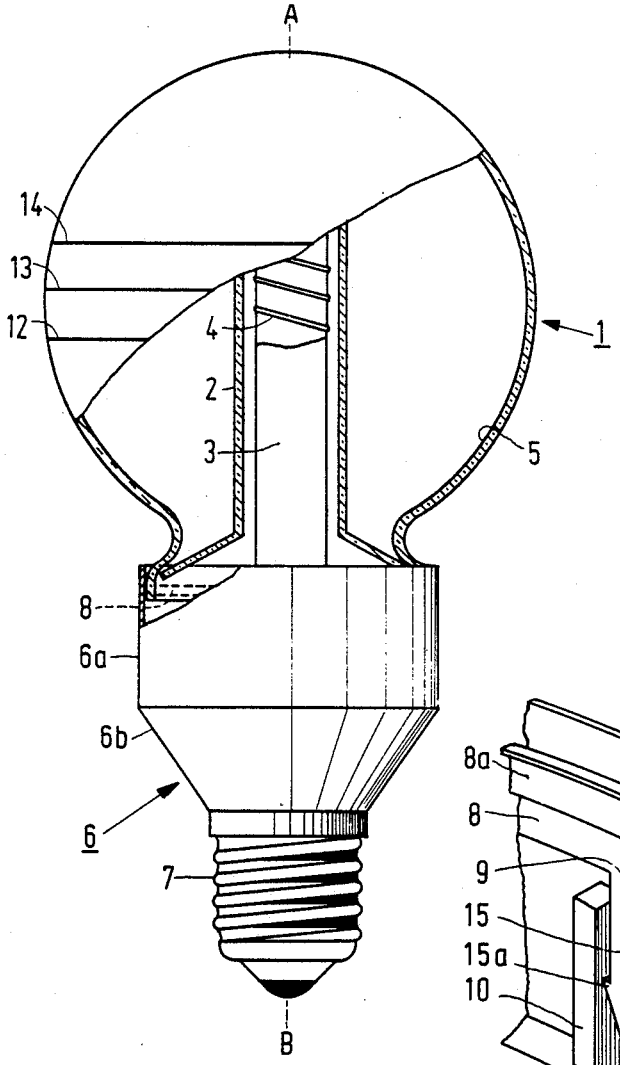
FIG. 1 shows an embodiment of an electrodeless low-pressure mercury vapor discharge lamp according to the invention, partly in a cross-section and partly in an elevational view

The lamp of FIG. 1 has a glass lamp envelope 1 of a discharge vessel which is sealed in a gas-tight manner and is filled with a small quantity of mercury and a rare gas (such as krypton). The discharge vessel has an indentation 2 accommodating a rod-shaped ferrite core 3. During operation of the lamp a high-frequency electromagnetic field is generated in the discharge vessel by means of a winding 4 surrounding the core and an electric supply unit connected thereto. Furthermore, the inner wall of the envelope 1 has a luminescent layer 5 which converts the ultraviolet radiation generated in the discharge vessel into visible light. Anti-interference rings 12, 13 and 14 are present on the outside of the lamp envelope.

A lamp bowl or shell of a synthetic material is secured to the lamp envelope 1. This lamp bowl has a cylindrical part (6*a*) and a tapered part (6*b*) provided with an Edison cap 7. The lamp envelope 1 is bulb-shaped and its side facing the lamp bowl 6 is provided with a circular raised edge portion 1*a* (see FIG. 2) whose outside surface has an annular metal strip 8 secured to it by means of an adhesive, such as glue or a cement. This strip has a plurality of regularly spaced, elongated projecting metal members or tongues extending substantially parallel to the lamp axis AB, which members are each undetachably accommodated between respective synthetic material ribs 10 and 11 likewise extending parallel to the longitudinal axis of the lamp and being present on the inside wall of the cylindrical portion (6*a*) of the lamp bowl 6.

Figure 2:
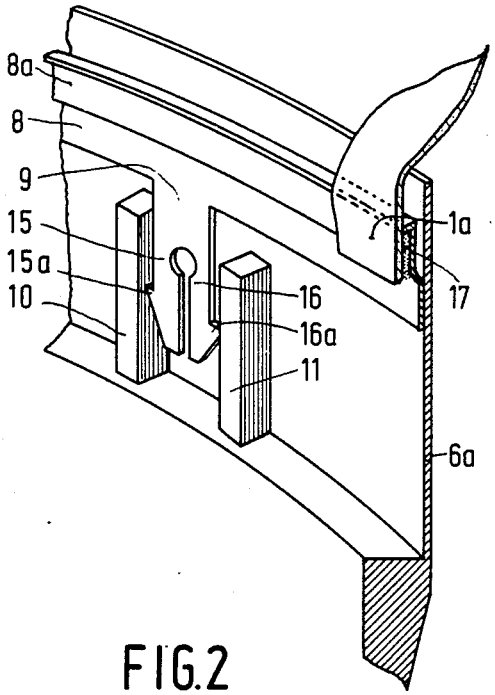
FIG. 2 shows a detail of an embodiment of the joint between the lamp bowl and the lamp envelope of the lamp of FIG. 1.

FIG. 2 diagrammatically shows in detail the joint between the lamp envelope and the lamp bowl. The circular glass edqe portion (1*a*) of the bulb-shaped envelope is only partly shown. The metal strip 8 has a plurality of spaced tongues (9) only one of which is visible. These plate-shaped elongated metal tongues (9) are punched out integrally with the strip.

The strip 8 is provided on its side facing the lamp envelope with an inwardly protruding bent edge 8*a*.

Between this edge and the proximate glass wall (1a) there is provided a small gap which is filled up with a cured cement mass 17 by means of which the strip 8 is adhered to the glass lamp envelope. The presence of the edge 8a prevents uncured cement when still soft from emerging from the said gap during manufacture of the lamp. The cement consists of a mixture of shellac, phenol formaldehyde resin, hexamethylene tetra-amine, silicon resin, colophonium, calcium carbonate and ethanol.

The plate-shaped tongues members 9 are each in the form of pairs of resilient tags 15 and 16. Near its free end each tag is formed into a sharp point (such as 15a and 16a), constituting a barb, on its side edge facing the relevant rib (10, 11), which is arranged to grip the rib, thus anchoring the member in the associated pair of synthetic material ribs.

During assembly of the lamp the glass lamp envelope is first provided on its lower side with the said strip having plate-shaped members which slightly project below the plane through the lower edge. Subsequently the lamp bowl is positioned against the lower side of the envelope in the direction of the longitudinal axis of the lamp. The resilient tags are slid between the substantially parallel ribs. The sharp-pointed tags formed as barbs are then anchored in the synthetic material, which preferably consists of a thermoplastic synthetic material such as polycarbonate.

The space bounded by the lamp bowl accommodates a high-frequency supply unit.

In a practical embodiment the diameter of the bulb-shaped glass discharge vessel is approximately 70 mm. The luminescent layer comprises a mixture of two phosphors, namely green-luminescing terbium-activated cerium magnesium aluminate and red-luminescing yttrium oxide activated by trivalent europium. A transparent conducting layer of fluorine doped tin oxide is present between the luminescent layer and the glass wall. It was measured that, when a power of approximately 13 W was supplied to the lamp, a luminous flux of about 900 lumens was produced.

What is claimed is:

1. An electric lamp, comprising:

(a) a lamp cap;

(b) an outer envelope defining a lamp axis;

(c) a light source arranged within said outer envelope energizable for emitting light;

(d) a base shell comprising synthetic material having a first end connected to said lamp cap and a tubular portion having an inner surface defining a second end for receiving said outer envelope; and (e) means for securing said outer envelope to said base shell comprising said tubular portion having a plurality of ribs on said inner surface substantially aligned with said lamp axis, a plurality of resilient tongues each secured to said outer envelope and having a barbed portion, and means for securing each tongue to said outer envelope, each of said tongues being positioned such that each barbed portion is resiliently biased against a corresponding rib, and said biased barbed portions being oriented with respect to said ribs such that each barbed portion is anchored against a corresponding rib to prevent translation of said tongues and said outer envelope away from said lamp cap and for slidably engaging a corresponding rib for allowing axial translation of said tongues and said outer envelope in the direction of said lamp cap.

2. An electric lamp as claimed in claim 1, wherein each tongue comprises a pair of oppositely directed barbed portions and said ribs are arranged in pairs and positioned such that each tongue is between a respective rib pair, the barbed portions of each tongue engaging a respective rib.

3. A lamp as claimed in claim 2, wherein said means for securing said tongues to said outer envelope comprises an annular strip to which said tongues are connected, and said outer envelope having a circular rim received in said lamp bowl second end to which said annular strip is fixed.

4. An electric lamp as claimed in claim 3, wherein said tongues and said annular strip are a single stamped metallic component.

5. An electric lamp as claimed in claim 4, wherein said annular strip is secured to said rim with an adhesive.

6. An electric lamp as claimed in claim 5, wherein said annular strip is provided on its side facing said rim with an inwardly protruding bent edge for preventing uncured adhesive from flowing out from between said rim and said annular strip.

7. A lamp as claimed in claim 1, wherein said means for securing said tongues to said outer envelope comprises an annular strip to which said tongues are connected, and said outer envelope having a circular rim received in said lamp bowl second end to which said annular strip is fixed.

8. An electric lamp as claimed in claim 7, wherein said tongues and said annular strip are a single stamped metallic component.

9. An electric lamp as claimed in claim 8, wherein said annular strip is secured to said rim with an adhesive.

10. An electric lamp as claimed in claim 9, wherein said annular strip is provided on its side facing said rim with an inwardly protruding bent edge for preventing uncured adhesive from flowing out from between said rim and said annular strip.

11. In an electric lamp assembly comprising an outer envelope defining a lamp axis, a light source within said outer envelope, a base shell having an opening dimensioned for receiving an end of said outer envelope, said shell having an inner wall terminating at said opening complementary in shape to the end of said outer envelope received in said opening, the improvement comprising:

guides arranged on said inner wall extending generally parallel to said lamp axis; and resilient tongues extending from said end of said outer envelope each corresponding to a said guide, said tongues being spaced for engaging a respective guide upon insertion of said tongues and envelope into said shell, said guides guiding said tongues into said shell;

and securing means for securing each tongue to said shell for preventing removal of said tongues and said outer envelope from said shell.

12. A lamp as claimed in claim 11, wherein said guides are arranged in pairs and each tongue is spaced for insertion between a corresponding pair of guides.

13. A lamp as claimed in claim 12, wherein each guide comprises a rib, and said securing means comprises each tongue having a barbed portion resiliently biasable against a said rib and oriented such that said barbed portion slidably engages said rib for allowing axial insertion of said tongues and said envelope into said shell and for anchoring in said rib for preventing removal of said tongues and said outer envelope from said shell.

14. A lamp as claimed in claim 13, wherein a said tongue comprises a pair of oppositely directed resiliently barbed portions each engaging a respective rib of a corresponding rib pair.

* * * * *